United States Patent [19]

Yoshikawa et al.

[11] 4,123,688

[45] Oct. 31, 1978

[54] SPARK PLUG CAP

[75] Inventors: Masazi Yoshikawa; Tomoe Sawada, both of Kyoto, Japan

[73] Assignee: Murata Manufacturing Co., Ltd., Kyoto, Japan

[21] Appl. No.: 756,919

[22] Filed: Jan. 5, 1977

Related U.S. Application Data

[63] Continuation-in-part of Ser. No. 656,723, Feb. 9, 1976, Pat. No. 4,082,980.

[30] Foreign Application Priority Data

| | | | |
|---|---|---|---|
| Feb. 13, 1975 | [JP] | Japan | 50-21425[U] |
| May 15, 1975 | [JP] | Japan | 50-65019[U] |
| May 17, 1975 | [JP] | Japan | 50-66088[U] |
| Jun. 12, 1975 | [JP] | Japan | 50-81296[U] |

[51] Int. Cl.[2] ..... H01J 7/44; H01J 13/46; H01J 23/16; H01K 1/62

[52] U.S. Cl. ..... 315/58; 313/135; 315/59; 123/169 R

[58] Field of Search ..... 315/58, 59; 313/135; 123/169 R

[56] References Cited

U.S. PATENT DOCUMENTS

| | | | |
|---|---|---|---|
| 1,317,834 | 10/1919 | Sweeney | 315/58 |
| 1,798,789 | 3/1931 | Gale | 315/58 |
| 1,982,950 | 12/1934 | Curtis | 315/58 X |
| 2,640,174 | 5/1953 | Short et al. | 315/59 X |
| 3,002,126 | 9/1961 | Noir | 315/58 |
| 3,124,718 | 3/1964 | Marks et al. | 315/58 |
| 3,683,232 | 8/1972 | Baur | 315/58 |

*Primary Examiner*—Saxfield Chatmon, Jr.
*Attorney, Agent, or Firm*—Morgan, Finnegan, Pine, Foley & Lee

[57] ABSTRACT

A spark plug cap is provided for use on a spark plug of an internal combustion engine to intensify sparking across the gap between central and ground electrodes of the plug. The spark plug cap includes a cap body which comprises upper and lower insulating body sections detachably interconnected together. The upper body section is provided with a terminal head adapted to be connected to an ignition current supply cord, while the lower body section with a connector socket for mechanically connecting the cap to the spark plug. A conductor rod extend through the cap body to electrically connect the terminal head with the center electrode of the spark plug. At least one capacitor unit is supported within the cap body and connected in parallel to the spark gap between the plug electrodes. The capacitor unit includes a cylindrical dielectric and a pair of electrodes positioned on the opposite end faces of the cylindrical dielectric.

17 Claims, 4 Drawing Figures

ELECTRICAL ENERGY AVAILABLE AT THE GAP

SPARK PLUG CAP

CROSS-REFERENCE TO RELATED APPLICATION

This application is a continuation-in-part of co-pending application Ser. No. 656,723 filed Feb. 9, 1976 for Spark Plug Cap, now U.S. Pat. No. 4,082,980.

BACKGROUND OF THE INVENTION

This invention generally relates to spark plug caps for use on spark plugs of an internal combustion engine to intensify sparking across the spark gap. In particular this invention relates to such spark plug caps having an improved cylindrical capacitor unit embedded therein.

Spark plugs are universally used in internal combustion engines to ignite compressed fuel-air mixture in the cylinders of internal combustion engines. The spark plug includes a pair of spaced electrodes, between which a high-potential electric current is passed from the secondary winding of the ignition coil to produce an ignition initiating spark across the gap between the electrodes.

In an attempt to improve combustion efficiency, efforts have been directed to strengthen or intensify the sparking at the spark plug gap. The expected results of the intensified sparking is almost perfect combustion of the fuel charge taking place in the engine cylinders, which in turn contributes to improved engine output and cleaner combustion or exhaust gases. The latter contribution is particularly advantageous nowadays when strict antipollution control is being imposed on automobile emission gases throughout the world. One prior attempt to strengthen the sparking at the spark plug gap is to introduce a capacitive device into the firing circuit of the ignition system. The capacitive device provides added electric energy across the spark plug gap resulting in intensified spark discharge thereacross. Baur U.S. Pat. No. 3,683,232 proposes to form a capacitor of high capacitance connected in parallel to the spark plug gap by fitting the spark plug cap on the spark plug. The capacitor includes the widened electrode 15 and the conductive screening shell 16 placed, respectively, within and around the plastic insulating body 12 which serves as a dielectric separating two electrodes. However, the spark plug cap of the aforementioned Baur U.S. patent has many disadvantages which make it extremely difficult to obtain the desired results. To mention a few, for example, the plastic insulating body of the cap fitted on the spark plug undergoes earlier deterioration under high temperature heat and severe vibration generated in the engine, which in turn causes a decrease in the capacitance of the capacitor. Since the capacitance has a critical effect on the strength of the spark discharge across the plug gap, the earlier decrease of the capacitance is apparently a detrimental factor contributing toward unacceptability of the Baur spark plug cap. The fact that the spark plug cap in the fitted condition is inevitably put to severe heat and vibration also poses other problems for the plug cap capacitor. For one thing, the capacitor electrodes, especially the conductive screening shell tends to be brought out of intimate engagement with the outer surrounding wall of the insulating body, forming more or less an air gap between the screening shell electrode and the dielectric body. For another thing, there is a strong possibility of the plastic insulating body being broken apart. These are also the factors that prevent the Baur cap from being universally employed on the spark plugs since in either of the above cases the plug cap capacitor gets out of order. In short, the Baur spark plug cap is fragile in nature and lacks mechanical as well as electrical stability which is essential for the cap to be used on heat and vibration transmitting spark plugs. In addition, the capacitor device of the Baur cap is bulky in structure and is not effectively protected against moisture and heat.

SUMMARY OF THE INVENTION

With the above noted problems in mind, it is an object of the invention to provide an improved device for use on a spark plug of an internal combustion engine to intensify sparking across the spark gap.

It is another object of the invention to provide an improved spark plug cap for use on a spark plug of an internal combustion engine to intensify sparking across the spark gap, which is highly resistant to heat, vibration and moisture.

It is a further object of the invention to provide a compact spark plug cap for use on a spark plug of an internal combustion engine to intensify sparking across the spark gap, which has at least one improved cylindrical capacitor unit of high mechanical and electrical stability incorporated therein.

It is a still further object of the invention to provide a spark plug cap for use on a spark plug of an internal combustion engine to intensify sparking across the spark gap, which includes a pair of detachably interconnected cap bodies and an improved cylindrical capacitor unit embedded in one cap body.

Briefly stated, there is provided, according to the invention, a spark plug cap for use on the spark plug of an internal combustion engine to intensify sparking across the gap between the central and ground electrodes of the spark plug. The spark plug cap includes an insulating cap body which comprises a pair of detachably interconnected body sections made of suitable insulating material. Means is provided in the insulating cap body for mechanically interconnecting the cap to the spark plug cap. Electrically conductive means extends through the cap body for supplying high tension ignition current from an ignition system of the engine to the central electrode of the spark plug. At least one cylindrical capacitor unit is rigidly supported within one body section and adapted to be electrically connected in parallel to the spark gap of the spark plug when the cap is fitted in place on the plug. The cylindrical capacitor unit comprises a generally cylindrical dielectric and a pair of annular electrodes attached at the opposite end faces of the dielectric. An instantaneous application of a high electrical potential across the spark plug electrodes by the ignition system causes a high-tension ignition current in the visible form of a spark to jump the gap between the electrodes and thus to ignite the compressed fuel-air mixture in the cylinder of the engine. The application of the high sparking potential across the plug electrodes causes, at the same time, the capacitor unit connected in parallel to the spark plug gap to be fully charged. The charged capacitor is then discharged across the electrodes when the spark jumps the spark plug gap providing an additional current flow across the gap. The result is that the spark at the gap is much intensified by discharging of the parallel capacitor unit.

DETAILED DESCRIPTION OF THE PREFERRED EMBODIMENT

Figure 1:
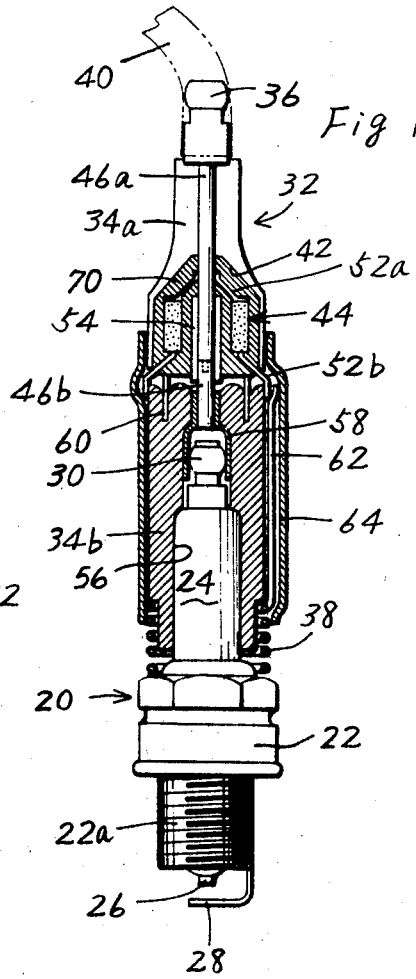
FIG. 1 is a vertical cross-sectional view of a spark plug cap embodying the invention in which a cylindrical capacitor unit is embedded within an insulating cap body and showing the spark plug cap fitted in place on a spark plug of an internal combustion engine.
Figure 3:
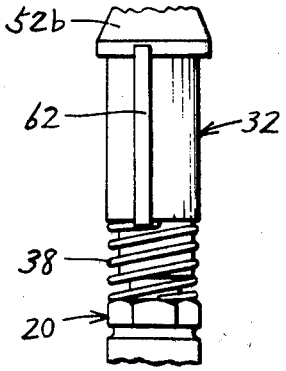
FIG. 3 is a partial view showing a ground connection between the spark plug and the spark plug cap of FIG. 1 via a conductive coil spring.

Referring now to the accompanying drawings, there is illustrated in FIG. 1 a spark plug cap according to one preferred embodiment of the invention. The spark plug caps of the invention are designed for use on the existing spark plugs universally used in internal combustion engines. As shown, the spark plug 20 typically includes an outer metal shell 22 with a threaded base 22*a* and a ceramic insulator 24 sealed into the metal shell, through which a central electrode 26 passes. A ground electrode 28 is fixed to the threaded base 22*a* of the metal shell 22 and a gap is formed between this electrode and the central electrode 26. Provided at the upper end of the central electrode 26 is a terminal 30 for making electrical connection with the ignition system of the engine. The illustrated spark plug cap 32 includes a generally cylindrical cap body which comprises upper and lower insulating bodies 34*a* and 34*b*, respectively, made of such insulating material as fiber reinforced plastics, epoxy resin, silicon rubber and ceramics. The insulating cap body has a terminal head 36 fixed to its upper end and an electrically conductive coil spring 38 attached around its lower end portion. The terminal head 36 is similar in shape to the plug terminal 30 and is provided for receiving a high-tension ignition cable 40 from the engine ignition system when the spark plug cap is fitted in place on the spark plug 20 as described hereinbelow. The conductive coil spring 38 is for making a necessary ground connection between the spark plug cap and the spark plug as also explained hereinbelow.

Figure 2:
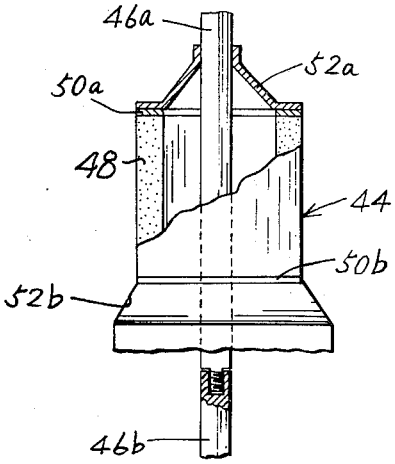
FIG. 2 is an enlarged view partly in cross-section of the cylindrical capacitor unit incorporated within the spark plug cap of FIG. 1.

There is formed in the upper cap body 34*a* a cavity 42 for accommodating a cylindrical tublar capacitor unit 44 and an electrically conductive rod 46*a* extends from the terminal head 36 axially and centrally through the upper cap body, the conductive rod having a male screw section at its lower end. The cylindrical capacitor unit 44 to be embedded within the cavity 42 comprises, as more clearly shown in FIG. 2, a cylindrical dielectric 48 and a pair of annular metal electrodes 50*a* and 50*b* fixedly attached to the opposite end faces of the cylindrical dielectric. A generally conical conductor ring 52*a* and a flared conductor ring 52*b* are electrically secured to the upper and lower capacitor electrodes 50*a* and 50*b*, respectively. It should be noted that the capacitor unit 44 is so disposed within the cavity 42 that the cylindrical dielectric 48 may surround the upper conductor rod 46*a* with the upper conductor ring 52*a* in electrical contact with the rod and the lower conductor ring 52*b* extending partly out of the cavity. A sleeve coupler 54 is formed of a suitable insulating resin and fittingly slipped onto the lower end portion of the upper conductive rod 46*a* with its bottom end projecting slightly out of the cavity. The capacitor accommodating cavity 42 is then filled with suitable moisture proof insulating material 70 such as epoxy resin keeping the capacitor unit 44 and the sleeve coupler 54 in place within the cavity. In order to snuggly receive the ceramic insulator 24 of the spark plug 20, there is formed an elongated generally cylindrical bore 56 in the lower insulating cap body 34*b*. Embedded centrally in the lower cap body near the top end of the bore is a conductive socket 58 for making both electrical and mechanical connection with the plug terminal 30 by gripping around the terminal when the ceramic insulator 24 is inserted into the bore 56. The connector socket 58 is electrically and mechanically connected with a lower conductive rod 46*b* which extends axially upwardly from the top end of the lower cap body 34*b*. The lower conductive rod 46*b* has a female screw section formed at its top end that is adapted to be screwed into the mating male screw section at the bottom of the upper conductive rod 46*b*. A generally ring shaped insulating member 60 is embedded partly within the lower cap body 34*b* with the upper end thereof extending upwardly from the top end of the cap body to abut the bottom end face of the upper cap body 34*a* at radial positions between the lower conductor ring 50*b* and the lower conductive rod 46*b* when the cap bodies 34*a* and 34*b* are interconnected together. A ground conductor in the form of an elongated strip 62 is attached to the outer wall of the lower cap body 34*b* and has its upper end electrically connected to the lower conductor ring 52*b* and its bottom end to the coil spring 38 which is fitted around the bottom of the lower cap body 34*b*. An outer protective sleeve 64 of a thermosetting resin is fittingly inserted over the substantial portion of the spark plug cap for the known purposes.

In order to assemble the spark plug cap 32 of the illustrated embodiment, the upper cap body 34*a* is first put close to the lower cap body 34*b* so that the lower conductive rod 46*b* may enter the insulating sleeve coupler 54. While keeping the upper and lower cap bodies in this longitudinally aligned position, the upper cap body 34*a* may then be rotated with respect to the lower cap body 34*b* to screw the male screw section of the upper conductive rod 46*a* into the female screw section of the lower conductive rod 46*b*. As the upper conductive rod is screwed into the lower conductive rod, the upper and lower cap bodies 34*a* and 34*b* are put closer together with the projecting portion of the insulating ring member 60 tightly abutting the bottom of the upper cap body 34*a* and with the lower conductor ring 52*b* fitted around the top of the lower cap body 34*b*. The outer protective sleeve 64 is finally inserted over the assembled cap bodies to complete the spark plug cap 32. It is noted that, in the assembled condition, the lower conductor ring 52*b* is kept in electrical connection with the ground conductor strip 62. Playing the most important role in tightly interconnecting the two cap bodies 34*a* and 34*b* together is, of course, the screw connection between the upper and lower conductive rods 46*a* and 46*b*. Both the insulating coupler 54 and the protective sleeve 64 also aid in keeping the cap bodies together in the assembled state.

With the above mentioned arrangement, when the spark plug cap 32 is fitted on the spark plug 20 by forcing down over the ceramic insulator 24, the plug terminal 30 is snugly received within the connector socket 58 making an electrical connection to the cap terminal 36 via the conductor rods 46*a* and 46*b*. Since, in this fitted condition, the coil spring 38 is held under compression between the spark plug cap 32 and the plug metal shell 22, another electrical connection is established between the upper conductive rod 46*a* and the ground electrode 28 via the cylindrical capacitor unit 50, conductor strip 62, coil spring 38 and the metal shell 22. Thus, the capacitor unit 44 is effectively connected in parallel to the spark gap between the central and ground electrodes 26 and 28, respectively.

Figure 4:
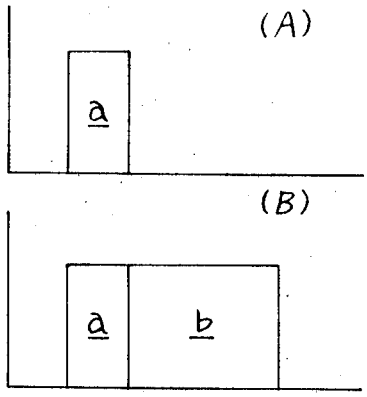
FIG. 4 is a schematic illustration comparatively showing electric energy available at the gap of the spark plugs with and without the cap of the invention fitted.

With the cap 32 fitted in place on the spark plug 20, the secondary wire in the form of a well-insulated ignition cable 40 from the ignition coil is attached to the terminal head 36 of the spark plug cap. During operation of the engine, a very high voltage induced in the secondary winding of the ignition coil is carried through the ignition cable 40 to the terminal head 36, and from there to the central electrode 26 of the spark plug 20 via the conductive rods 46*a* and 46*b*, connector socket 58 and plug terminal 30. The application of the high voltage across the central and ground electrodes 26 and 28 causes high-tension current to jump the gap therebetween forming a spark across the gap. This spark in turn ignites the compressed fuel-air mixture in the cylinder of the internal combustion engine. The application of the sparking potential across the plug electrodes causes, at the same time, the capacitor unit 44 in parallel to the spark plug gap to be charged up to a predetermined rated level. The charged capacitor unit is then discharged across the spark plug gap when a spark jumps thereacross after the application of the sparking potential. In other words, the capacitor unit is first charged by the high sparking potential applied across the spark plug electrodes and then discharged when sparking occurs between the electrodes as the result of the applied sparking potential. Thus, the high discharge current from the capacitor unit jumps across the spark plug gap at substantially the same time as the ignition current from the ignition coil jumps thereacross. The result is that the spark across the gap is much intensified by the additional current supply from the charged capacitor unit 44. FIG. 4 shows schematically the amount of electrical energy available or "consumed" at the spark plug gap to produce a combustion-initiating spark. In a conventional spark plug with no capacitor unit connected in parallel to the gap, the amount of electric energy available at the gap for the sparking is limited to that supplied from the ignition system of the engine and indicated at *a* (see FIG. 4A). While in the spark plug fitted with the novel spark plug cap of the invention, the amount of electrical energy available at the gap is the sum total of the energy *a* from the ignition system and the energy *b* from the charged capacitor unit, the latter being dependent upon the rated capacitance of the capacitor unit employed. As is apparent from the illustration, the additional energy supplied from the capacitor unit greatly contributes to produce the intensified spark across the gap. The capacitance of the capacitor unit may vary according to the rated value of circuit components in the ignition system. However, satisfactory results are obtained for the existing spark plugs by using a capacitor unit with the rated capacitance between 100 to 200 pF.

As mentioned, the spark plug equipped with the novel cap of the invention is capable of producing sparks across the gap, which are much improved in their strength. Generation of intensified spark across the gap effects ready and almost complete combustion of the fuel-air mixture in the engine cylinder resulting in a greatly improved engine output power, accelerative force and mileage. As to the mileage of automobiles, it has been found that it is improved by approximately 20 to 30% when the spark plug caps of the invention are utilized. Almost complete combustion of the fuel charge initiated by the intensified spark produces relatively clean combustion gases with reduced carbon monoxide and hydrocarbon content. This is particularly advantageous nowadays when strict antipollution control is called for throughout the world. The data entered in the table below manifest themselves how much carbon monoxide and hydrocarbon content of combustion by-product gases is reduced when the novel plug caps of the invention are used on the spark plugs of the internal combustion engine. Three automobile engines of different total piston displacements are put to the test to determine carbon monoxide and hydrocarbon contents in the exhaust gases from the engines with or without the plug caps fitted on the spark plugs.

| Types of Engines Tested (Total in Piston Displacement) | CO content in % | | | HC content in PPM | | |
|---|---|---|---|---|---|---|
| | Without Plug Caps | With Plug Caps | Reduction Percentage | Without Plug Caps | With Plug Caps | Reduction Percentage |
| A (2,000 cc) | 1.8 | 1.2 | 33.0 | 550 | 450 | 18.2 |
| B (1,800 cc) | 2.2 | 1.5 | 31.8 | 625 | 460 | 26.4 |
| C (1,600 cc) | 2.6 | 1.7 | 34.6 | 630 | 460 | 26.9 |
| D (1,400 cc) | 3.5 | 2.5 | 28.5 | 750 | 530 | 29.3 |

As is apparent from the foregoing description, novel spark plug caps are provided according to the invention, which can be readily fitted on the commonly used spark plugs for the internal combustion engine to greatly augment or intensify ignition starting sparks across the spark plug gaps. The spark across the gap is intensified by the discharging of a charged capacitor across the gap, which itself is initiated when sparking takes place across the gap. It has also be found that the spark jumps across the gap in the form of a bold pillar in the cap fitted spark plug while in the spark plug without the cap the spark is in the form of a thin thread. Generation of such intensified sparks across the spark plug gap assures almost complete combustion of the fuel charge in the engine cylinder, the desired results of which are already discussed above. In addition, intensified sparks effectively burn out carbon or other deposits on the plug electrodes and on the cylinder wall thus rendering the cap fitted spark plugs self-cleaning type. Further, nearly perfect combustion taking palce in the engine cylinder is advantageous in that it substantially reduces the formation of incomplete combustion gases which are known to have detrimental effects on lubricating oil in the oil pan. The provision of the capacitor unit in parallel to the spark plug gap has additional advantages. For example, residual electromagnetic energy is found in the secondary winding of the ignition coil immediately after each sparking takes place across the spark plug gap. This residual electromagnetic energy has an adverse effect on the operation of the ignition system in that it prevents subsequent current impluse of the desired energy level from being induced in the secondary winding of the ignition coil. However, with the cap fitted spark plug, the undersired residual electromagnetic energy is entirely absorbed in the capacitor unit each time it is induced in the secondary winding, thus causing no detrimental effects on the proper operation of the ignition system.

The spark plug caps, when used on the spark plugs of the internal combustion engine, are inevitably subject to severe mechanical vibration and moisture conditions. Accordingly, in order to assure the spark plug cap of long operating life, it is essential, among others, to support the capacitor unit within the cap body rigidly and in moisture proof manner. Also, since the capacitor unit and its associated electrical parts are to be disposed in a relatively small confine within the cap body despite high sparking potential is applied between the center and ground electrodes of the spark plug, a sufficient dielectric strength must be provided around the capacitor unit. According to the present invention, by disposing the cylindrical capacitor unit 44 within the cavity 42 of the upper insulating cap body 34*a* and filling the cavity with highly moisture proof insulating material such as epoxy resin, the capacitor unit is securely and rigidly supported within the insulating filling 70 integral with the upper cap body against vibration. The moisture proof filling material 70 also effectively protects the capacitor unit against water and moisture. Whenever a high sparking potential is applied between the center and ground electrodes of the spark plug, the same potential may tend to cause a creepage discharge between the lower conductor rod 46*b* and the lower conductor ring 52*b* through a space between the upper and lower cap bodies 34*a* and 34*b*. As already explained hereinabove, the insulating ring member 60 projects upwardly from the lower cap body in tight abutment against the bottom of the upper cap body at the radial positions between the conductor rod 46*b* and the lower ring 52*b*, while the insulating sleeve coupler 54 projects slightly downward beyond the bottom of the upper cap body. With the arrangement, both the insulating ring member 60 and the insulating sleeve coupler 54 serve to extend to a substantial degree the creepage distance between the conductor rod 46*b* and the lower conductor ring 52*b* thereby preventing the undesirable creepage discharge between them when the high sparking potential is applied between the plug electrodes. The fact that the cylindrical capacitor units can be disposed in the center of the insulating body makes it possible to provide spark plug caps of compact design. In addition, the embedded capacitor unit is effectively protected against shock and vabration as well as heat and moisture. The illustrated structure of the spark plug cap is advantageous in that the coil spring 38 employed is effective to keep and assure the desired ground connection between the capacitor unit 44 and the plug metal shell 22 under such conditions where the spark plug and the cap are subject to severe vibrations. The conductive coil spring interposed between the spark plug and the cap also serves to dissipate heat from the engine before it is transferred to the insulating cap body. In designing and employing the coil spring 38, care should be taken to prevent arcing from occuring between adjacent turns of the coil spring since such arching not only causes loss of electric energy stored in the capacitor unit but also might pose a danger to human beings who have access to the plug equipped engine for repair and maintenance services. For arc prevention, it is suggested to form the coil spring such that each and every turn of the spring is kept in intimate contact with adjacent turns or is spaced more than five millimeters (0.2 inch) away from adjacent turns. Then, no arching would occur between adjacent turns of the coil spring even when high-tension spark intensifying current is repeatedly passed through the coil due to the discharging of the capacitor unit. Or alternately, an insulating sleeve may be placed around the coil spring.

Since the insulating cap bodies 34*a* and 34*b* are detachably interconnected by the screw connection, they can readily be separated as desired, for example, when replacing a defect or brokendown cap body section, particularly the capacitor embedded upper body with a new one leaving the lower body intact.

The spark plug caps of the invention are simple in construction and inexpensive in manufacturing cost. The major component part is a capacitor unit placed in parallel circuit to the spark plug gap. Capacitor units suitable for use in the plug caps of the invention are readily available in the market, and rigid in construction and stable in performance.

While the invention has been particularly shown an described with reference to a preferred embodiment, it should be understood by those skilled in the art that various modifications may be made without departing from the spirit and scope of the invention.

What we claim is:

1. A spark plug cap for electrically and mechanically connecting a spark plug to an ignition current supply cord to intensify sparking across the gap between central and ground electrodes of the spark plug, comprising an insulating body, said body having means for mechanically connecting said cap to said spark plug and terminal means adapted to be connected to said supply cord, electrically conductive means extending through said body to electrically connect said terminal means to the center electrode of said spark plug and at least one capacitor unit supported within said body and electrically connected in parallel to said spark gap and characterized in that said capacitor unit comprises a cylindrical dielectric through which said conductive means extends and a pair of electrodes positioned on the opposite end faces of said cylindrical dielectric base.

2. A spark plug cap as defined in claim 1 in which said capacitor unit is entirely embedded in said body.

3. A spark plug cap as defined in claim 1 in which said insulating body is made of a member selected from the group consisting of fiber reinforced plastics, epoxy resin, silicone rubber and ceramic material.

4. A spark plug cap as defined in claim 1 in which said insulating body comprises a pair of detachably interconnected body sections, said capacitor unit being embedded in one of said body sections.

5. A spark plug cap as defined in claim 4 in which said one body has a cavity filled with moisture-proof insulating material, said capacitor unit being embedded within said filling material.

6. A spark plug cap according to claim 5, wherein one electrode of said capacitor is electrically connected to said electrically conductive means and the other electrode is electrically coupled to the ground electrode of the spark plug.

7. A spark plug cap according to claim 6, wherein said electrically conductive means includes a first conductor extending generally centrally through said one body section and a second conductor extending generally centrally through the other body section, said first and second conductors being releasably engagable with each other.

8. A spark plug cap according to claim 7, wherein said other body section is made of electrically insulative material and includes third electrical conductor means coupling said other electrode of said capacitor to the ground electrode of the spark plug.

9. A spark plug cap according to claim 8, wherein said third electrical conductor includes an electrically conductive member adjacent the outer periphery of said other body section, which is coupled to the other electrode of said capacitor by a generally flared conductor ring.

10. A spark plug cap according to claim 9, which further includes a generally ring-shaped insulating member secured to the end of said other body section, which resides adjacent said one body section, said insulating member adapted to abut said one body section when said body sections are coupled together and to reside between said second conductor and said flared conductor ring.

11. A spark plug cap according to claim 10, which further includes an electrically conductive coil spring connecting said electrically conductive member to the ground electrode of the spark plug.

12. A spark plug cap according to claim 11, wherein every turn of said coil is spaced more than about five millimeters away from adjacent turns.

13. A spark plug cap according to claim 11, wherein every turn of said coil spring is kept in contact with adjacent turns.

14. A spark plug cap for electrically and mechanically connecting a spark plug to an ignition current supply cord to intensify, sparking across the gap between central and ground electrodes of the spark plug, comprising an insulating body, said body having means for mechanically connecting said cap to said spark plug and terminal means adapted to be connected to said supply cord, electrically conductive means extending through said body to electrically connect said terminal means to the center electrode of said spark plug and at least one capacitor unit supported within said body and electrically connected in parallel to said spark gap, said capacitor unit comprising a cylindrical dielectric through which said conductive means extends, and a pair of electrodes positioned on the opposite end faces of said cylindrical dielectric base, one electrode of said capacitor being electrically connected to said electrically conductive means and the other electrode being connected to the ground electrode of the spark plug.

15. A spark plug cap as defined in claim 14 in which said grounding means comprises an electric conductor connected to said other electrode of said capacitor unit and an electrically conductive coil spring for electrically connecting said conductor with the ground electrode of said spark plug.

16. A spark plug cap as defined in claim 15 in which every turn of said coil spring is spaced more than five millimeters away from adjacent turns.

17. A spark plug cap as defined in claim 15 in which every turn of said coil spring is kept in contact with the adjacent turns.

* * * * *